United States Patent [19]

Shibashita et al.

[11] Patent Number: 4,688,385

[45] Date of Patent: Aug. 25, 1987

[54] METHOD AND AN APPARATUS FOR STARTING A TURBINE HAVING A SHRINKAGE-FITTED ROTOR

[75] Inventors: Naoaki Shibashita; Hajime Toriya; Kiyoshi Shimomura; Haruo Urushidani; Ryoichi Kaneko, all of Hitachi, Japan

[73] Assignee: Hitachi, Ltd., Tokyo, Japan

[21] Appl. No.: 694,054

[22] Filed: Jan. 23, 1985

[30] Foreign Application Priority Data

Jan. 24, 1984 [JP] Japan ..... 59-11356

[51] Int. Cl.[4] ..... F01K 13/02

[52] U.S. Cl. ..... 60/646; 60/657

[58] Field of Search ..... 60/646, 657

[56] References Cited

U.S. PATENT DOCUMENTS 4,173,869 11/1979 Martin, Jr. ..... 60/646

4,204,258 5/1980 Zitelli et al. ..... 60/646 X

FOREIGN PATENT DOCUMENTS 596725 2/1978 U.S.S.R. ..... 60/646

*Primary Examiner*—Allen M. Ostrager

*Attorney, Agent, or Firm*—Antonelli, Terry & Wands

[57] ABSTRACT

A method of starting a turbine having a shrinkage-fitted rotor provided by shrinkage-fitting discs onto a shaft comprises the steps of raising the temperature of the rotor above a predetermined temperature determined from a physical value of the material constituting the rotor and, thereafter, raising the rotational speed of the turbine from the turning speed to the rated speed, whereby the centrifugal stress on raising the speed acts on the discs in a state wherein the value of fracture toughness of the discs fitted on to the shaft has increased.

2 Claims, 15 Drawing Figures

METHOD AND AN APPARATUS FOR STARTING A TURBINE HAVING A SHRINKAGE-FITTED ROTOR

FIELD OF THE INVENTION

The present invention relates to a method and an apparatus for starting a turbine having a shrinkage-fitted rotor.

BACKGROUND OF THE INVENTION

In recent years, heat power plants and atomic power plants have had increased capacity and, as a result, a turbine rotor which is employed in a steam turbine has also been increased in diameter. In the low-pressure turbine, in particular, which operates at low temperature and low pressure and which is large in specific volume, a so-called "shrinkage-fitted rotor" prepared by shrink-fitting discs onto a shaft is adopted as the rotor from the standpoint of manufacture of the base materials.

In particular, since, in an atomic power plant, the steam produced in a nuclear reactor is low in temperature and in pressure as compared with that in case of the heat power plant, and since, as a result, the volumetric flow rate per a unit output thereof is four to five times as large as that of the heat power plant, the above-mentioned shrinkage-fitted rotor has hitherto been widely employed in the field.

When the disc is shrink-fitted onto the shaft, a sufficient coupling for shrinkage-fit is provided between both the disc and the shaft and, at the same time, a key is provided therebetween, for the purpose of preventing slippage from taking place therebetween due to the torque imparted to moving vanes mounted onto the outer periphery of the disc.

During the operation of the steam turbine, however, wet steam is carried into a key groove and is condensed within the same. When the turbine operation is continued under the condition wherein the water exists in the key groove, it is likely that a crack is produced.

This crack is what is called "stress/corrosion cracking" which occurs when tensile stress is caused to act on a material in the presence of water. It is known that stress/corrosion cracking occurs when three factors—the properties of the material, environmental conditions such as ambient temperature and steam, and operational stress—have satisfied a specified condition. Since the shrinkage-fitted rotor is structured by shrinkage fit, a tensile stress acts thereon even when the operation of the turbine is stopped, and further a centrifugal force is additionally imparted thereto when the turbine is in operation. Therefore the operational stress becomes large, with the result that the stress/corrosion cracking occurs depending solely upon the remaining two factors.

The tensile stress which is produced in the disc by reason of the shrinkage fit becomes large as the rotor temperature is low. Therefore a rise in rotational speed of the rotor despite low temperature, in particular, at the time of starting of the turbine, results in the addition of a tensile stress due to the centrifugal force acting on the disc and moving vanes to the tensile stress due to the shrinkage fit. In consequence, the crack is rapidly enlarged to produce the possibility that a serious accident wherein the disc breaks takes place.

OBJECT OF THE INVENTION

The object of the present invention is to provide a method and an apparatus for preventing a crack due to the above-mentioned stress corrosion cracking phenomenon from progressing with respect to the low-pressure turbine having a shrinkage-fitted rotor structure.

SUMMARY OF THE INVENTION

The present invention is characterized in that, with notice taken of the fact that the fracture toughness value of material constituting the disc varies with the temperature thereof, at the time of starting the turbine the temperature of metal is raised to a predetermined temperature within a period of so-called "turning operation" in which the rotation speed of the rotor is low and, thereafter, the turbine speed is raised up to a "rated speed". Further, the present invention is also characterized in that, for the purpose of raising the metal temperature during its turning operation, this turning operation is performed with the pressure inside the turbine casing, i.e., the pressure inside the condenser maintained to have a level which is lower (higher, in terms of absolute pressure) than the degree of vacuum under a state of normal operation.

DETAILED DESCRIPTION OF THE PREFERRED EMBODIMENT

Description will now be made of the causes whereby the stress/corrosion cracking phenomenon occurs in the turbine wherein the disc is shrinkage-fitted.

Figure 1:
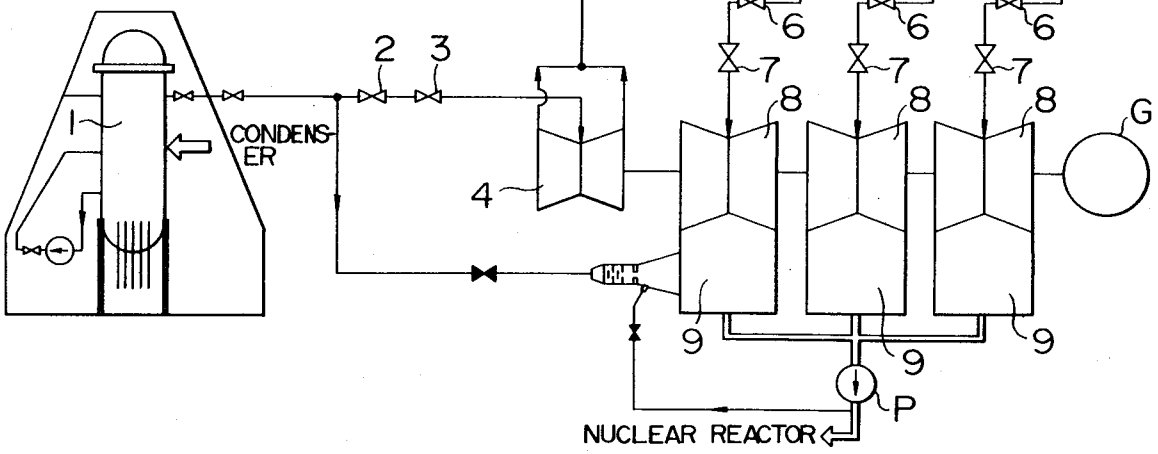
FIG. 1 is a systematic view which shows the steam system involved in an atomic power turbine plant.

To explain, by taking an atomic power turbine as an example, as shown in FIG. 1, the steam which has been generated in a nuclear reactor 1 or steam generator passes through a main steam stop valve 2 and a steam adjusting valve 3 to reach a high pressure turbine 4. After it has worked in the high pressure turbine 4, the steam has its moisture removed in a moisture separator 5 or moisture separating/reheating device. Thereafter, passing through intermediate stop valves 6 and intercept valves 7, the steam is introduced into low pressure turbines 8. After having worked in the low pressure turbines 8, the steam is discharged into condensers 9 in which it is condensed. Thereafter, it is again sent into the nuclear reactor 1 or steam generator through the operation of a pump P. A symbol G is an electricity generator. It is to be noted here that the steam in the high pressure turbine 4 and the low pressure turbines 8 is almost entirely wet steam.

Figure 2:
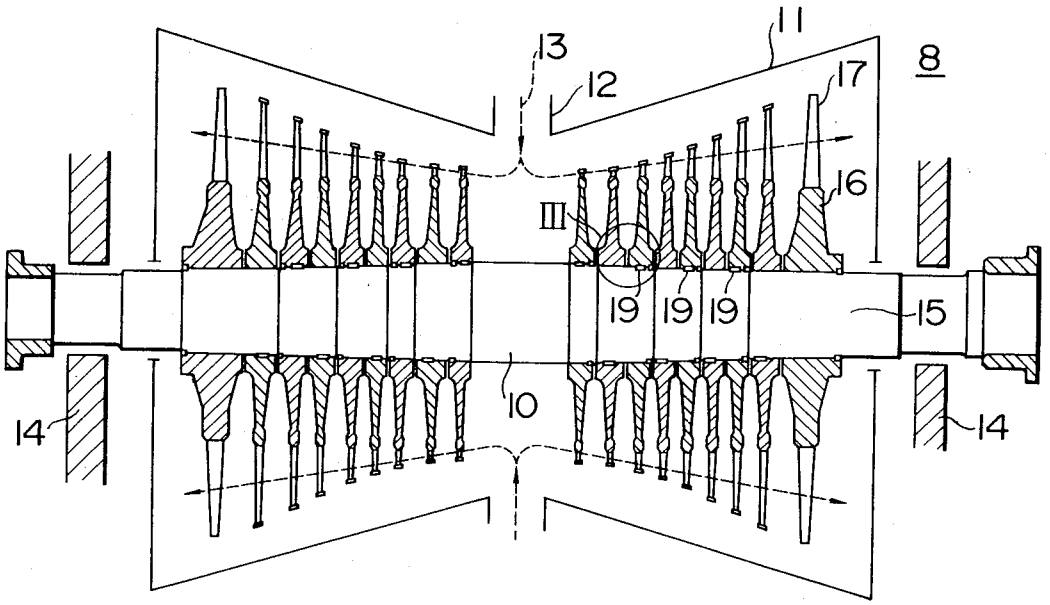
FIG. 2 is a sectional view of a rotor of a low-pressure turbine.

A section of a rotor of the low pressure turbine 8 is shown in FIG. 2. A low pressure rotor 10 is enclosed by a low pressure casing 11. A steam inlet portion 12 is provided at the central part of the casing 11. As shown in FIG. 2 by chain lines 13, steam at a temperature of approximately 200° C. is allowed to enter the casing 11 through the steam inlet portion 12 and branches into rightward and leftward flows. The steam thus works at the stages on each side and, while its temperature and pressure are thus being decreased and its wetness is being increased, it flows to the downstream side. The rotor 10 of the low pressure turbine 8 comprises a shaft 15 supported by bearings 14, discs 16 which are shrinkage-fitted onto the shaft 15, and moving vanes 17 which are provided, respectively, on the outer peripheries of the discs 16.

Figure 3:
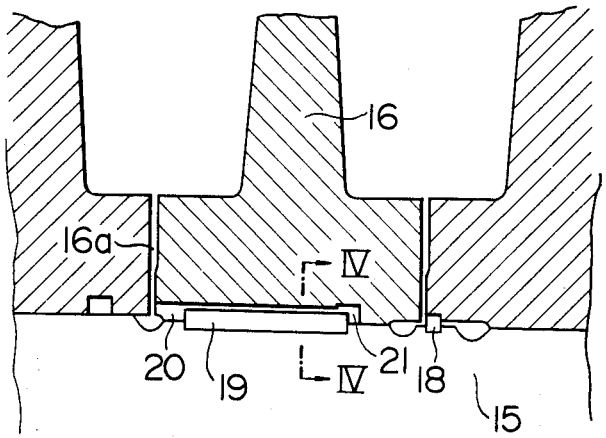
FIG. 3 is a detailed view of a shrinkage-fitted portion of the rotor.
Figure 4:
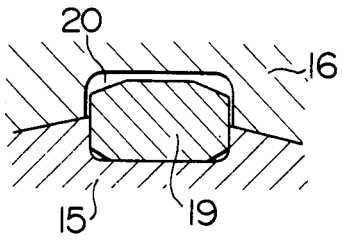
FIG. 4 is a sectional view taken along the line IV—IV of FIG. 3.
Figure 5:
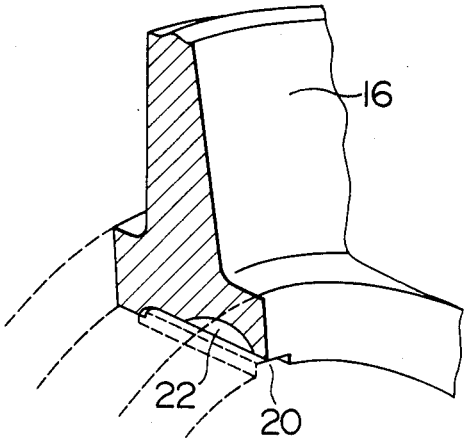
FIG. 5 is a detailed view of a shrinkage-fitted portion in which a crack is caused.
Figure 6:
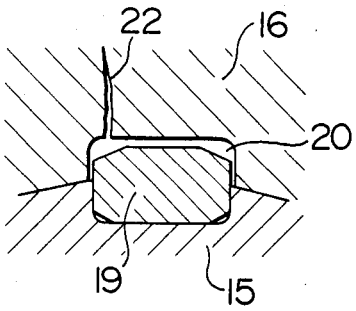
FIG. 6 is a sectional view of the crack portion.

An enlarged detailed structure of a portion III shown in FIG. 2 is shown in FIGS. 3 and 4.

When the disc 16 is shrinkage-fitted onto the shaft 15, a sufficient coupling for the shrinkage fit is provided between the disc 16 and the shaft 15 so that the torque imparted to the moving vanes 17 from the steam may be transmitted to the shaft 15 without causing any slippage of the disc 16 relative to the shaft 15. Further, against an unexpected slippage between both, a lock ring 18 is provided with respect to the axial slippage and a wheel key 19 is provided with respect to the circumferential slippage.

The shaft 15 is shrinkage-fitted with the disc 16 and the wheel key 19 intended to prevent the circumferential slippage is provided in a key way 20 which is formed in the shaft 15 and the disc 16 axially thereof. The key-way portion 20 formed in the disc 16 is opened into a steam inlet side end 16*a* of the disc 16 and at the rear end of the key way 20, a relief groove 21 is formed at the shrinkage-fitted portion over the entire circumference thereof so as to mitigate the concentration thereon of a stress produced due to the centrifugal force and torque acting on the disc 16.

However, during the turbine operation, wet steam enters into a gap between the key way 20 and the wheel key 19 via from the steam inlet side end 16*a* of the disc 16, whereby a crack 22 may be caused in the inner diameter side periphery of the disc 16, particularly, in the key-way portion 20 thereof.

The remaining life period Y of the rotor in which a crack has been caused is generally expressed as follows.

$$Y = \frac{a_{CR} - a}{f} \tag{1}$$

where $a_{CR}$: the critical depth of the crack, a: the present depth of growth of crack, and f: the progressive rate of the crack, and this rate is represented by a physical value or measured value of material of the disc.

Further, the critical depth $a_{CR}$ of the crack is expressed as follows.

$$a_{CR} = \left(\frac{K_{IC}}{C \cdot \sigma}\right)^2 \tag{2}$$

where $K_{IC}$: the value of fracture toughness and this value is a physical value of material of the disc, C: constant, and $\sigma$: the stress which acts on the defective portion of the disc.

Figure 7:
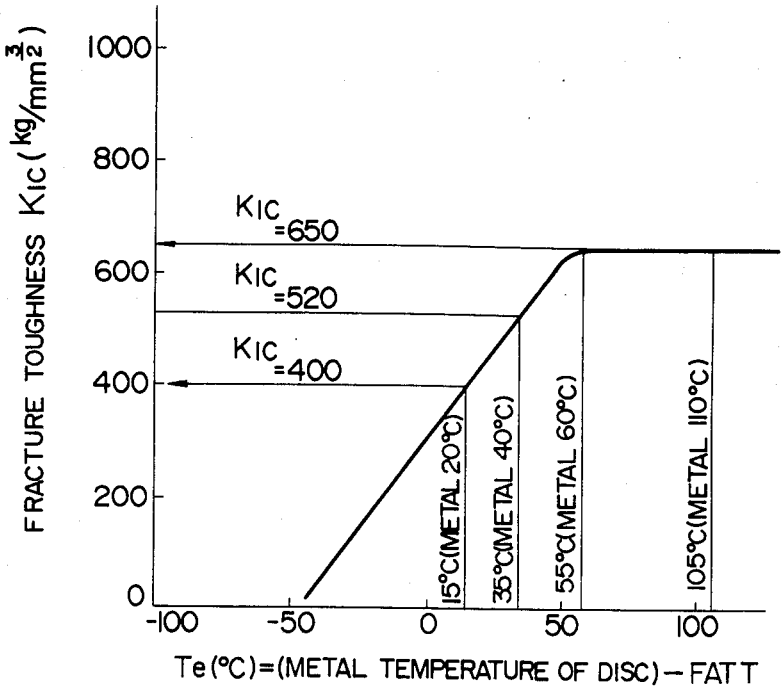
FIG. 7 is a characteristic diagram which shows the relationship between the fracture toughness value of material of the disc and the temperature thereof.

An example of the fracture toughness value of material of the disc is shown in FIG. 7. The difference between the metal temperature of the disc and the fracture area transfer temperature (FATT) of material of the disc is plotted on the abscissa Te, while the fracture toughness value $K_{IC}$ of material of the disc is plotted on the ordinate. Since the fracture area transfer temperature FATT is determined by the life of the material of the disc, $K_{IC}$ is varied with the metal temperature of the disc. Accordingly, as seen in FIG. 7, as the metal temperature of the disc becomes high, the value of $K_{IC}$ increases and, when the metal temperature of the disc has become equal to, or greater than, a specified temperature, the value of $K_{IC}$ becomes constant. Accordingly, the critical depth $a_{CR}$ of the crack in the formula (2) also increases depending upon the metal temperature of the disc, so that the remaining life period Y of the rotor also increases as seen in the formula (1).

Figure 8:
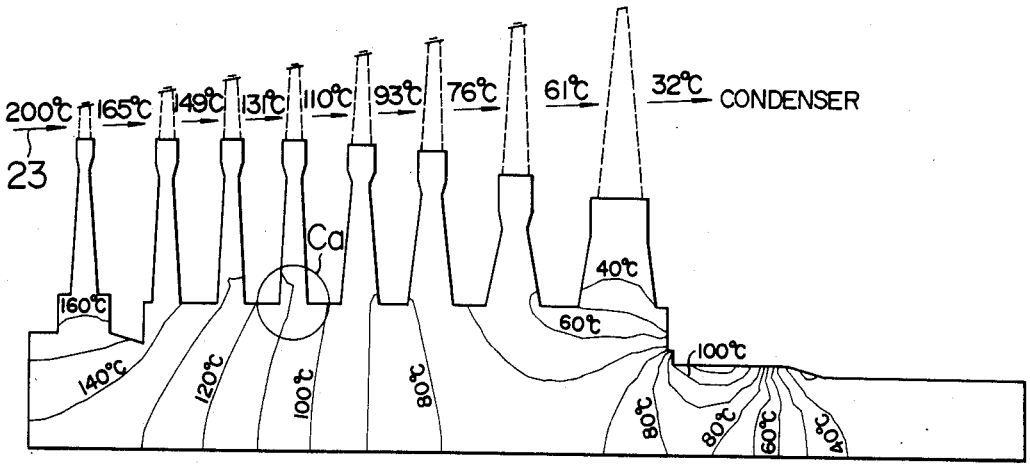
FIG. 8 is a view which shows an example of the effect of simulation of a stationary temperature distribution of the low-pressure rotor in operation.
Figure 9:
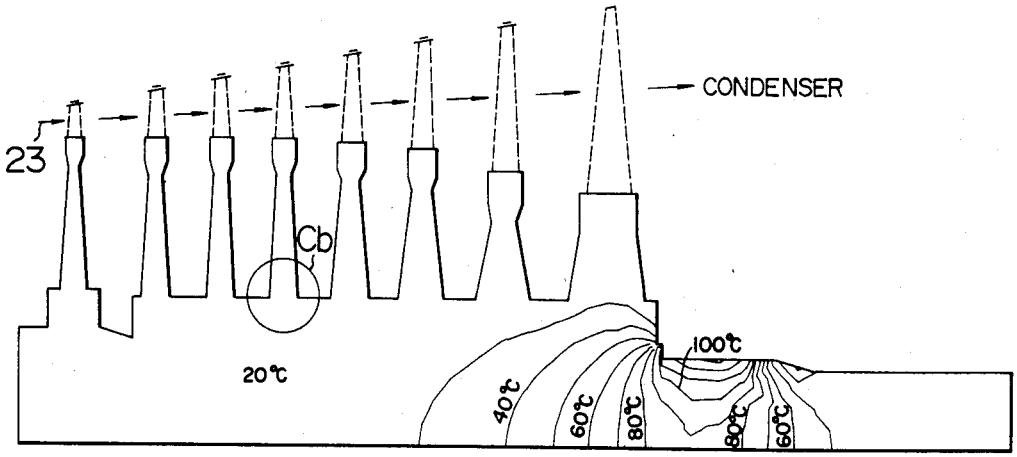
FIG. 9 is a view which shows an example of the effect of simulation of a temperature distribution of the low-pressure rotor on starting.

An example of the effect of simulation of a stationary temperature distribution of the low pressure rotor in operation having the shrinkage-fitted rotor is shown in FIG. 8. An example of the effect of simulation of a temperature distribution of the low pressure on a starting rotor is shown in FIG. 9. Referring now to FIG. 8, steam 23 whose temperature is 200° C. is allowed initially to flow into the first stage of the low-pressure turbine and works thereat. Thereafter, while its temperature becomes low, the steam 23 goes through each stage of the low-pressure turbine to become steam having a temperature of 32° C. which then is allowed to enter the condenser. When notice is now taken of the shrinkage-fitted portion $C_a$ at the fourth stage of the low-pressure turbine, the metal temperature thereof is approximately 110° C. Next, when review is made of the temperature distribution of FIG. 9 which is made when the low-pressure turbine is started, the rotor as a whole is cooled down to in the vicinity of a room temperature although the area thereof in the vicinity of the rightward end thereof which is exposed to the sealing steam is partially kept at a temperature of 100° C. The metal temperature of the shrinkage-fitted disc portion $C_b$ at the fourth stage of the low-pressure turbine is approximately 20° C.

Under the conditions which are illustrated in FIGS. 8 and 9, comparison is made of the remaining life periods of the rotor containing a crack therein. When it is now assumed that the fracture area transfer temperature FATT of material of the disc is 5° C., the stress $\sigma$ which acts on the defective portion of the disc is 30 Kg/mm$^2$, the constant C is 2, the present depth of the crack is 20 mm, and the progressive rate of growth f of the crack is 5 mm/year, then the shrinkage-fitted portion $C_a$ in the stationary temperature distribution on operation of FIG. 8 has the following values. That is to say, the fracture toughness value $K_{IC}$ is determined to be 650 Kg/mm$^{3/2}$ from the characteristic diagram of FIG. 7, the critical depth $a_{CR}$ of the crack is 117 mm, and the remaining life period Y is 19 years. Similarly, the shrinkage-fitted portion $C_b$ in the temperature distribution on starting of FIG. 9 is such that $K_{IC}$=400 Kg/mm$^{3/2}$, $a_{CR}$=44 mm, and Y=5 years.

From the above, it will be understood that, at the shrinkage-fitted portion of the low-pressure rotor, operating the low-pressure turbine under the cooled condition results in a decrease in the critical depth $a_{CR}$ of the crack due to a small fracture toughness value $K_{IC}$ of material of the disc due to a low metal temperature of the disc, and further in a decrease in the remaining life period of the rotor.

In other words, if the low-pressure turbine is increased up to a normal rotational speed under the condition wherein the metal temperature of the shrinkage-fitted portion of the rotor remains low, the critical depth of the crack is reached in a relatively short period because its value is small, with the result that a serious accident is likely to occur. On the contrary, if the low-pressure is increased up to such a normal rotational speed under the condition wherein the metal temperature of said shrinkage-fitted portion of the rotor is kept high, the rotor will not be fractured and normally operate even when the crack is more or less enlarged, because the fracture toughness value $K_{IC}$ is large.

Figure 10:
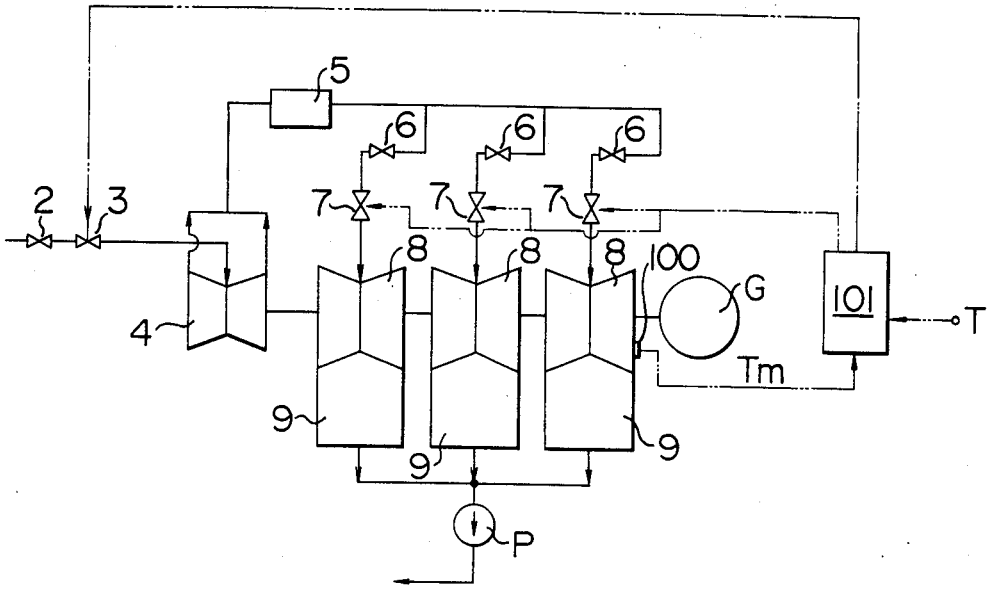
FIG. 10 is a schematic view of a turbine embodying the present invention.

FIG. 10 shows the construction of a turbine plant embodying the present invention. This embodiment is provided with a temperature sensor 100 for sensing the metal temperature of the rotor of the low-pressure turbine 8, and a control device 101 which is connected to receive a signal from this temperature sensor 100 and which, when the rotor temperature has increased to a predetermined temperature, opens the adjusting valve 3 to permit an increase in rotational speed of the low-pressure turbine.

The control device 101 controls the degree of opening of the intercept valve 7 which is intended to control the amount of steam used to preheat the low-pressure turbine 8 during its turning operation which precedes to a rise in rotational rotor speed of the low-pressure turbine 8.

When it is now assumed that, in the low-pressure turbine having experienced its operation for a certain period of time, a crack has been caused in the key way and that the progressive rate of this crack is known from several periodic examinations, the relationship between the remaining life period and the critical depth $a_{CR}$ of the crack can be determined from the above-mentioned formula (1).

Assume that the progressive rate of the crack is 6 mm/year as a result of the periodic examinations, and the present depth of the crack is 10 mm. When it is desired, on this assumption, that the remaining life period Y is at least 8 years, Y=8 years, a=10 mm, and f=6 mm/year are substituted into the formula (1). Then, $a_{CR}$ will be 58 mm.

Since the operational stress $\sigma$ and the constant C at the time of the rated speed are known from the material of the disc, coupling for shrinkage fit between the shaft and disc, and centrifugal force at the time of the rated speed, of the low-pressure turbine in question, the value of $K_{IC}$ can be determined from the formula (2).

That is to say, when it is assumed that $\sigma$=34 Kg/mm$^2$ and C=2, the value of $K_{IC}$ will be 520 Kg/mm$^{3/2}$.

On the other hand, if the material quality of the disc, and the life of the material thereof, i.e., its thermal treatment, are known, then the fracture area transfer temperature FATT as well as the relationship between Te and $K_{IC}$ shown in FIG. 7 can be determined in advance.

When it is now assumed that FATT=5° C., the metal temperature of the rotor is determined to be 40° C. since the value of Te corresponding to $K_{IC}$=520 is determined to be 35° C. from the characteristic diagram of FIG. 7.

That is, if the low-pressure turbine is allowed to operate with its metal temperature kept above 40° C., a remaining life period of 8 years will, at present, be guaranteed.

The temperature distribution of the rotor during the normal operation of the low-pressure turbine is above 40° C. as shown in FIG. 8. Under normal operation, therefore, the above requirement is satisfied.

However, most of the discs are kept at a temperature of approximately 20° C. Therefore, if the turbine speed is raised up to a rated speed under such disc-temperature, a remaining life period of 8 years will not be guaranteed.

When the value of Te is 55° C. (at this time, the metal temperature is 60° C.), the value of fracture toughness $K_{IC}$ is 600 K/mm$^{3/2}$ from the characteristic diagram of FIG. 7. Therefore, the remaining life period Y will be increased by making the value of Te 55° C. (In this case, the remaining life period is approximately 11 years when it is assumed that the other conditions remain unchanged.)

Since the relationship between the remaining life period and the metal temperature of the rotor is primarily determined if the above formulae (1) and (2) and the characteristic diagram of FIG. 7 are given, a desired metal temperature is determined in connection with a remaining life period.

The desired metal temperature thus determined is inputted, as Ts, into the control device 101 of FIG. 10 and, when the metal temperature Tm sensed by the temperature sensor 100 has become equal to, or higher than, the predetermined temperature Ts, the turbine rotor speed is raised. By so doing, it is possible to achieve the initial object.

Although the metal temperature of the rotor is indeed low during the turning operation prior to raising the turbine speed, there is no fear that the rotor is fractured because, during this period of time, of all the stresses acting on the disc, the one due to centrifugal force is small.

Figure 11:
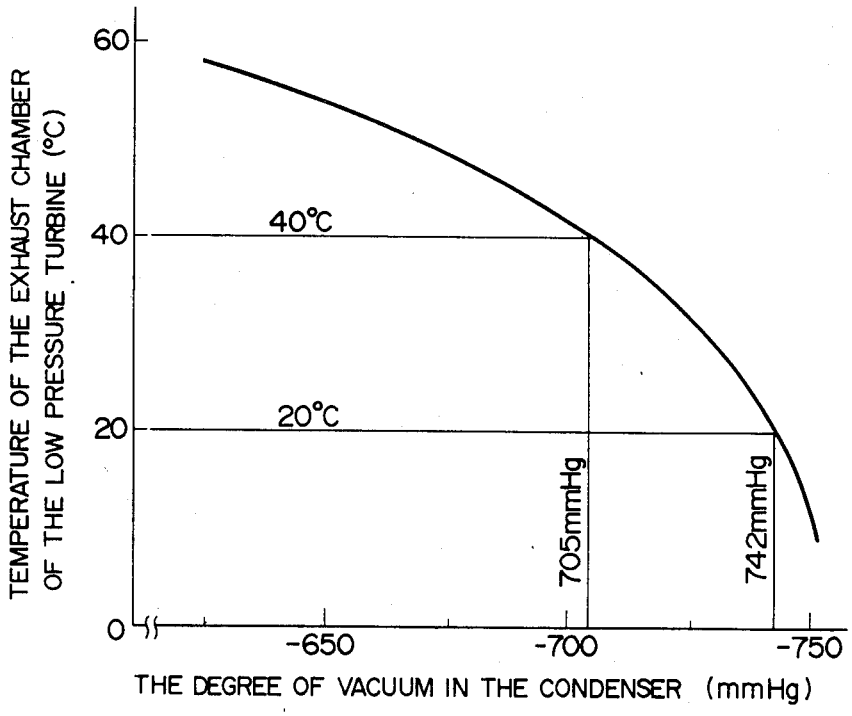
FIG. 11 is a characteristic diagram which shows the relationship between the degree of vacuum in the condenser and the temperature of an exhaust chamber in the low-pressure turbine.

One of the methods of varying the temperature of the low-pressure turbine 8 at the time of, for example, starting the same is a method of varying the degree of vacuum in the condenser 9. In FIG. 11, it is shown how the temperature of the exhaust gas chamber of the low-pressure turbine varies in response to the degree of vacuum in the condenser 9. Since the metal temperature of the rotor of the low-pressure turbine and the temperature of the exhaust steam chamber thereof are substantially equal to each other during the turning operation, the metal temperature of the rotor can be controlled by varying the degree of vacuum in the condenser during the turning operation.

When it is now desired to control the metal temperature of the rotor to 40° C., it will be understood from the characteristic diagram of FIG. 11 that it is sufficient to carry out the turning operation while the degree of vacuum in the condenser is kept to be −705 mmHg in terms of gauge pressure.

An example of controlling the degree of vacuum in the condenser will now be described with reference to FIG. 12.

Figure 13:
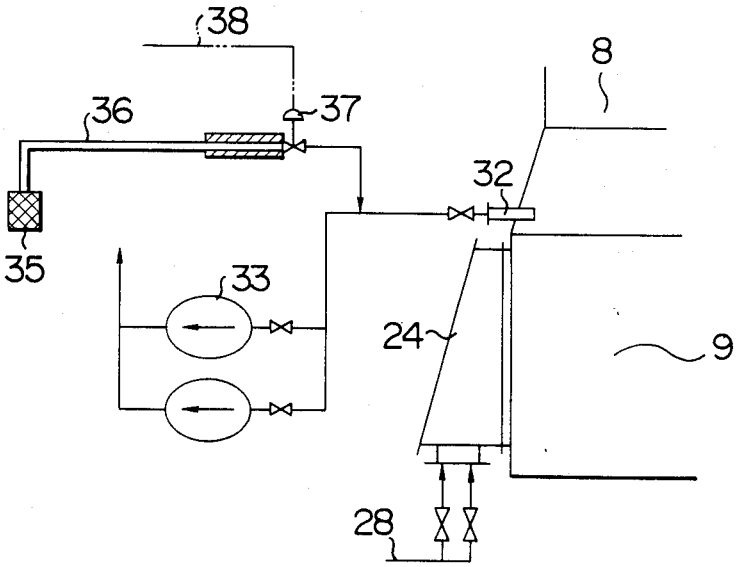

The method of controlling the degree of vacuum in the condenser 9 includes a method of controlling the amount of cooling water pumped up from a cooling water receptacle 27 by means of a cooling water pump 26 and supplied into a water chamber 24 of the condenser 9 at the side of its cooling water inlet via a cooling water supply pipe 28. This control of the amount of cooling water is effected, in accordance with a control signal 38, by a cooling-water adjusting valve 29 provided at the midway of a cooling-water supply pipe 30 connected to a water-releasing section 31 from a water chamber 25 of the condenser 9 at the side of its cooling water outlet. Another method of controlling the degree of vacuum in the condenser 9 is such that, as stated in Japanese Patent Laid-Open No. 54303/73, a gas such as air is introduced from a filter 35 into the condenser 9 through a gas introduction pipe 36 and a gas inlet 39, whereby the degree of vacuum in the condenser 9 is controlled by providing a gas adjusting valve 37 whose opening is controlled by the control signal 38, midway of the gas introduction pipe 36, and by controlling the valve 37 so that the detected value of a condenser-pressure sensor 105 may become a desired value. Further, where an air extractor 33 is a steam driven ejector, it is possible to control the degree of vacuum in the condenser 9 by arranging the system as shown in FIG. 13. Namely, the gas adjusting valve 37 may be provided on a pipe line connecting a connecting pipe 32 and the ejector 33, for controlling the degree of vacuum in the condenser.

Figure 12:
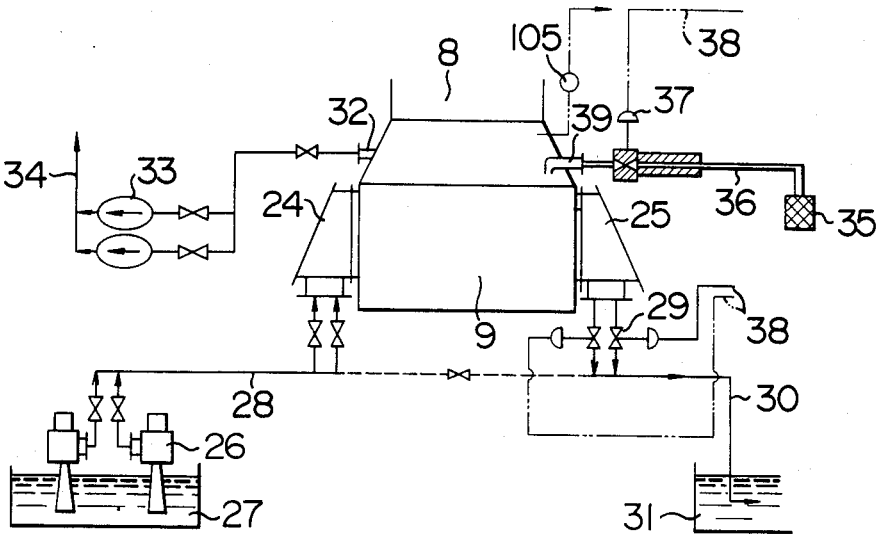
FIGS. 12 and 13 are view which show control systems for the degree of vacuum in the condenser, respectively.

In the embodiment of FIG. 12, the degree of vacuum in the condenser is feedback-controlled by receiving a signal of the pressure sensor 105 into a pressure controller (not shown) and feeding control signal from this pressure controller into the adjusting valves 29, 37 so that the degree of vacuum in the condenser may become equal to a desired value set beforehand. In FIG. 12, the two methods of controlling the degree of vacuum in the condenser have been shown. These two methods may be used at the same time, or either one may be used independently.

Where the metal temperature of the rotor of the low-pressure turbine is indirectly controlled by controlling the vacuum degree in the condenser, the turbine must continue to undergo the turning operation for a certain period of time in a state wherein the condenser is being kept at a desired degree of vacuum. The time period which is required for equalizing the metal temperature of the low-pressure rotor with the temperature of the exhaust steam chamber of the low-pressure turbine is determined from the initial temperature and the heat capacity of the low-pressure rotor and therefore can be empirically determined from the capacity of the low-pressure turbine. For this reason, when starting the turbine, the turning operation is continued for a certain period of time after a desired degree of vacuum is reached, and thereafter the turbine speed may be raised.

Concretely, the above-mentioned control is embodied by providing a timer which starts when the desired pressure has been reached and issues a signal for permitting a rise in rotational speed of the turbine after the time limit set in the timer has elapsed within the pressure controller of the condenser.

Figure 14:
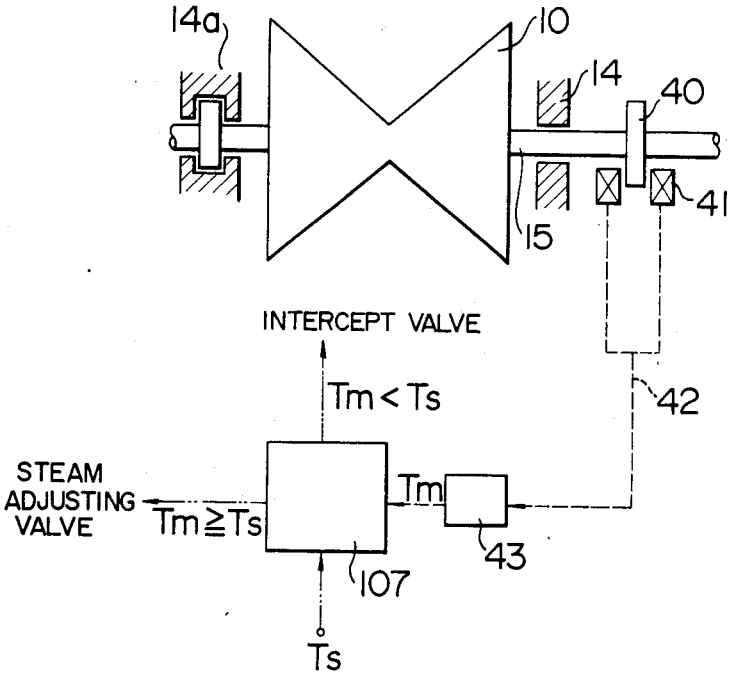
FIG. 14 is a principal view which shows the method of detecting an extension difference of the low-pressure rotor.

The method of monitoring the temperature of the low-pressure rotor 10 includes a method of monitoring from the extension of the rotor itself resulting from the temperature distribution in the low pressure rotor by using a differential extension indicator which is installed onto the low-pressure rotor 10 as shown in FIG. 14. The differential extension of the rotor is measured by an extension sensor 41 which is provided in a manner that its sensor elements are opposed to each other so as to clamp a ring 40 mounted onto the shaft 15 of the low-pressure rotor 10, whereby a differential extension signal 42 is transmitted to the differential extension indicator 43.

The leftward end of the shaft 15 in FIG. 14 is supported by a thrust bearing **14*a* and, when the metal temperature of the rotor 10 increases, the thermal extension of the shaft 15 occurs, solely, to move the ring 40 to the rightwards. Therefore, the metal temperature of the rotor 10 can be indirectly known by measuring the gap between the sensor elements 41 and the ring 40 by this sensor 41**.

Since the output signal of the differential extension indicator 43 corresponds to the metal temperature of the rotor, the following procedure may be taken. That is to say, this metal temperature Tm thus sensed is compared, in a comparator 107, with the predetermined temperature Ts. When the former temperature has become equal to, or higher than, the latter temperature, a signal for permitting a rise in rotational speed of the turbine is generated. When the metal temperature Tm is lower than the predetermined temperature Ts, the turbine is caused to undergo the turning operation so as to preheat the rotor by way of the intercept valve 7.

Further, as the method of monitoring the metal temperature of the low-pressure rotor, a method of providing temperature sensors at a plurality of portions of the turbine casing around the rotor to thereby determine the metal temperature, by arithmetic operation, from the measured values of those temperature sensors is well known. This known method may also be applied.

Figure 15:
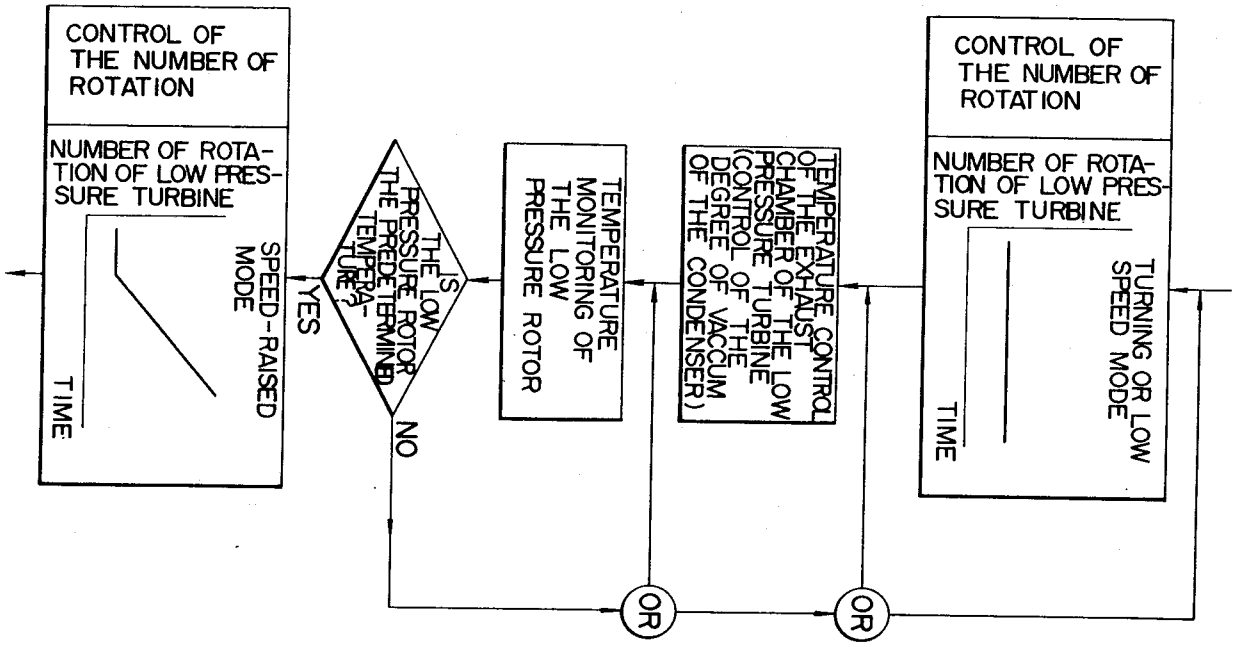
FIG. 15 is a flow chart for explaining the method of operating the turbine in accordance with the present invention.

In FIG. 15, the flow of the operation according to the turbine operation method of the present invention is shown. It is now assumed that the low-pressure turbine is under the mode of "turning" in the step of controlling the number of rotations or low-speed operation. Under this mode, as stated above, the degree of vacuum in the condenser is controlled for the purpose of making the temperature of the exhaust gas chamber of the turbine a predetermined temperature. At this point, when setting the temperature and vacuum degree, they should be set with some allowance to the following limit values. This is because, in the conventional turbine plant, since no consideration is given to the possible cracks due to the stress corrosion cracking phenomena at the shrinkage-fitted portion of the disc of the turbine, the lower limit of vacuum degree in the condenser which prevents any decrease in this vacuum degree and the upper limit of the temperature of the exhaust chamber, which tends to lower any increase in this temperature, are set in the turbine plant itself as a preference means to prevent the overheating of the final stage therein. Next, the above-mentioned rotor-temperature monitoring is performed and it is determined whether or not the rotor temperature has become equal to the predetermined temperature. Where the rotor temperature has not increased to the predetermined temperature, then the operational procedure is returned to the upstream side of the illustration. Thus, resetting the number of rotations, resetting the temperature of the exhaust gas chamber of the low-pressure turbine, or monitoring the metal temperature of the rotor are repeatedly carried out. When the rotor temperature has reached the predetermined temperature, the turbine is set into a speed-raised mode in the step of controlling its number of rotations, and then an ordinary starting operation is performed.

When putting the present invention into practical use, the above-mentioned method of operating the turbine can be carried out in any manner manually, semi-manually, or automatically.

It should be noted here that, if it is necessary to keep the rotor temperature high at the time of slowing down the speed of the turbine, it is sufficient to take the same operational procedures as at the time of starting the turbine.

The effects of the calculations in the case of controlling the rotor temperature by using the turbine operating method of the present invention will now be described below.

Assume now that the degree of vacuum in the condenser is kept at a value of −742 mmHg in terms of gauge pressure and, in this state, the turbine is allowed to undergo the turning operation until the metal temperature of the low-pressure rotor becomes equal to the temperature of 20° C. of the exhaust gas chamber of the low-pressure turbine and, thereafter, the turbine speed is increased up to its rated number of rotations. At this time, as in the above-mentioned calculation example, $K_{IC}=400$ Kg/mm$^{3/2}$, $a_{CR}=44$ mm, and $Y=5$ years at the shrinkage-fitted portion Cb. Next, assume that the degree of vacuum in the condenser is kept at a value of −705 mmHg and, in this state, the turbine undergoes the turning operation until the metal temperature of the rotor becomes equal to the temperature of 40° C. of the exhaust gas chamber of the low-pressure turbine and, thereafter, the turbine speed is increased up to its rated number of rotations. At this time, $K_{IC}=520$ Kg/mm$^{3/2}$, $a_{CR}=75$ mm, and $Y=11$ years at the shrinkage-fitted portion Cb. When this is compared with the values which have been obtained under the conditions wherein the degree of vacuum is −742 mmHg, the critical depth $a_{CR}$ of crack is 1.7 times as large as, and the remaining life period Y is 2.2 times as long as, the latter values, respectively.

As described above, the use of the turbine operating method of the present invention makes it possible to keep the metal temperature of the rotor as high as possible and, at the same time, to elongate, with respect to the rotor having the shrinkage-fitted portion, the period required for the crack resulting from the stress corrosion cracking phenomena to reach its critical value.

Further, when operating the turbine, no large additional systems are required, so that the additional cost of facilities is low.

What is claimed is:

1. A method of starting a turbine having a shrinkage-fitted rotor provided by shrinkage-fitting discs onto a shaft, said turbine being a low pressure turbine from which discharge steam is directly introduced into a condenser, the method comprising the steps of:

increasing the metal temperature of said shrinkage-fitted rotor to a value above the temperature at which the value of the fracture toughness of the material of said discs becomes larger than a value of the fracture material of said discs determined by the critical depth of a crack that has occurred at an inner diameter portion of said discs and a stress acting on said crack due to centrifugal force, said increasing of the metal temperature of said shrinkage-fitted rotor being carried out by intentionally making an absolute pressure in said condenser higher than an absolute pressure during normal operation thereof; and then increasing the rotational speed of said turbine from a relatively low rotational speed to the normal operational speed thereof.

2. A method according to claim 1, wherein the critical depth of the crack is derived in accordance with the following formula:

$$Y=(a_{CR}-a)/f$$

wherein:

$a_{CR}$ is the critical depth of the crack, a is the present depth of the crack, f is the progressive rate of growth of the crack, Y is the remaining life period of the rotor.

* * * * *